United States Patent [19]

Canonne et al.

[11] 4,057,716

[45] Nov. 8, 1977

[54] CIRCUIT BREAKER TRIP AND RELEASE TYPE CONTROL MECHANISM

[75] Inventors: Paul Canonne; Gérard Neumann, both of Barentin, France

[73] Assignee: Societe d'Appareillage Electrique Saparel, Saint Marcellin, France

[21] Appl. No.: 622,795

[22] Filed: Oct. 15, 1975

[30] Foreign Application Priority Data

Oct. 16, 1974 France ..... 74.34781

[51] Int. Cl.[2] ..... H01H 3/32

[52] U.S. Cl. ..... 200/153 H

[58] Field of Search ..... 200/153 R, 153 H, 153 G, 200/153 J

[56] References Cited

U.S. PATENT DOCUMENTS 3,371,178 2/1968 Lallemand ..... 200/153 H

*Primary Examiner*—James R. Scott

*Attorney, Agent, or Firm*—Sughrue, Rothwell, Mion, Zinn and Macpeak

[57] ABSTRACT

Trip and release type control mechanism comprises, between two laterally spaced bed-plates, a trip knob, a release knob, a main connecting rod, a secondary connecting rod, a retaining connecting rod, a control cam, a click, or latch and a release lever. The release lever extends parallel to the bed-plates and pivots about a pin parallel to the bed-plates. The click or latch abuts against a catch stop of release lever, with movement of the release lever being practically perpendicular to the click or latch at the level of the catch stop.

9 Claims, 7 Drawing Figures

CIRCUIT BREAKER TRIP AND RELEASE TYPE CONTROL MECHANISM

FIELD OF THE INVENTION

The invention concerns trip and release type control mechanisms; such mechanisms can be used for the most varied controlling such as the controlling of valves for fluids, or again for the controlling of electrical apparatus and more particularly of circuit-breakers.

BACKGROUND OF THE INVENTION

Numerous control mechanism which comprise a release device which is to operate under the action of an order which is as weak as possible, and must be, as far as possible, insensitive to vibrations and to shocks, are known. In practice, known mechanisms require, because of various friction between the parts which constitute them, high-level release orders. This friction causes therefore poor sensitivity, poor regularity in performance; moreover, known mechanisms are sensitive to shocks due to the manipulating of the trip knob. This generally requires the "hardening" of the release device to make it insensitive to these shocks and this gives rise, of course, to a loss of sensitivity of the release device.

The present invention is intended to obviate the disadvantages of known mechanisms and to obtain a sensitive mechanism which is regular in operation and practically insensitive to the shocks and vibrations compatible with the normal use of the mechanism.

SUMMARY OF THE INVENTION

The control mechanism according to the invention comprises, between two bed plates, a trip knob, a main connecting rod, a secondary connecting rod, a retaining connecting rod, a control cam, a click or click latch, a flap, or release lever, a release knob. In the tripped position, the click is pushed by a roller driven by the retaining connecting rod and presses on a catch stop of the flap. Release is obtained by an effort exerted on the flap which, by pivoting, releases the click. The flap, being parallel to the bed plates, requires an effort perpendicular to the bed-plates.

The retaining connecting rod is, to great advantage, constituted by two parts between which is situated the roller which exerts a pressure on the click. It comprises also two projecting contours between which the click is situated.

The flap can be installed optionally, by inverting it, on either side of the click, this enabling great versatility of installation of the control mechanism, since the effort exerted on the flap must suddenly change directions when the flap is inverted; the flap can therefore have an effort exerted on it on either side of the control mechanism.

The arranging of the flap makes it insensitive to shocks due to the manipulating of the trip and release knobs, these shocks being parallel to the bed-plates. The arrangement makes the control mechanism practically insensitive to the vibrations of the wall to which it is fixed.

The invention will be well understood from the following description of an example of embodiment illustrated by the accompanying figures.

DESCRIPTION OF THE PREFERRED EMBODIMENT

Figure 1:
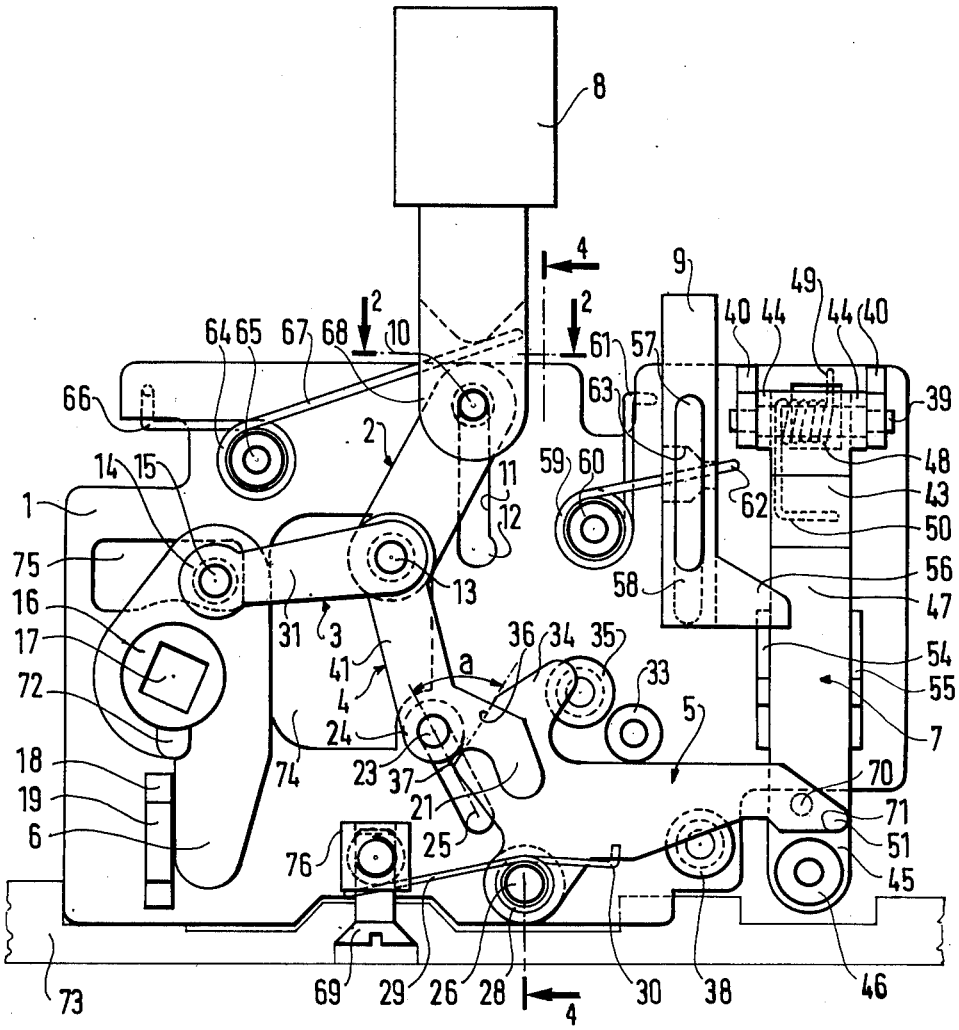
FIG. 1 is an elevation view of a mechanism according to the invention in the released position.
Figure 2:
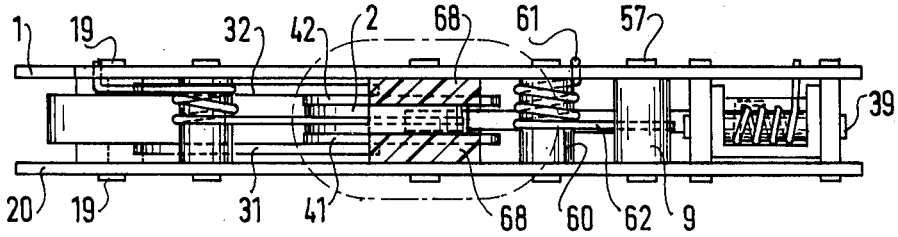
FIG. 2 is a horizontal sectional view of the mechanism in FIG. 1 about lines 2—2.
Figure 3:
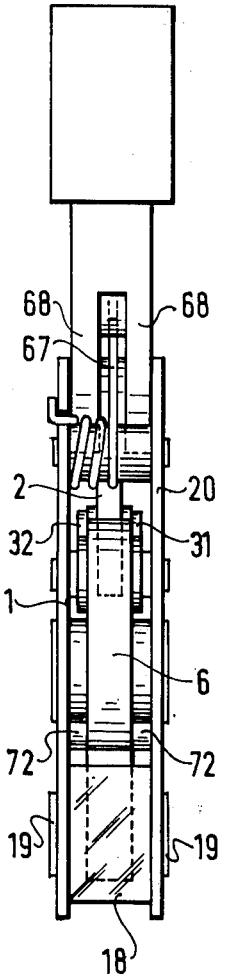
FIG. 3 is a left-hand view of the mechanism in FIG. 1.

FIG. 1 is a elevation view of a control mechanism, in the released position, one of the bed-plates being removed. The references used in that figure designate the same parts in FIGS. 2 to 7. The control mechanism is comprised between two bed-plates 1 and 20 to which it is fixed. FIG. 1 shows a bed-plate 1, a main connecting rod 2, a secondary connecting rod 3, a retaining connecting rod 4, a click or latch 5, a control cam 6, a flap or release lever 7, a trip knob 8 and a release knob 9 for manually controlling the release of latch 5.

The trip knob 8 is articulated about an axle 10 common with the main connecting rod 2; that axle can move in an opening 11 in the bed-plates 1 and 20. Each opening comprises, at the lower end, a notch 12. The secondary connecting rod 3 is constituted by two identical parts 31, 32, between which the main connecting rod 2 is inserted, the main connecting rod and the secondary connecting rod are articulated together by a pin 13. The end 14 of the secondary connecting rod 3 comprises a pin 15 which holds together the two parts 31, 32 which constitute it and the control cam 6 comprised between the two parts of the secondary connecting rod. The control cam 6 comprises two cylindrical shoulders 16 which are accommodated in circular openings of the bed-plates 1 and 20 to enable the control cam to pivot. A hole 17 having a square cross-section centred on the cylindrical shoulders crosses right through the control cam, this making it possible to insert therein a square pin (not shown) which is driven in a rotating movement by the pivoting of the control cam about its cylindrical shoulders. The cam 6 comprises two studs on each side so as to position the cam 6 between the bed-plates and to guide it during its rotation; the cam 6 is therefore in contact with the bed-plates 1 and 20 only by the studs, this considerably reducing the friction. The control mechanism being in the released position, in FIG. 1, the movement of the control cam is limited by a stop 18 held in place by the bed-plates 1 and 20, by means of shoulders 19 shown in FIGS. 1, 2 and 3.

Figure 4:
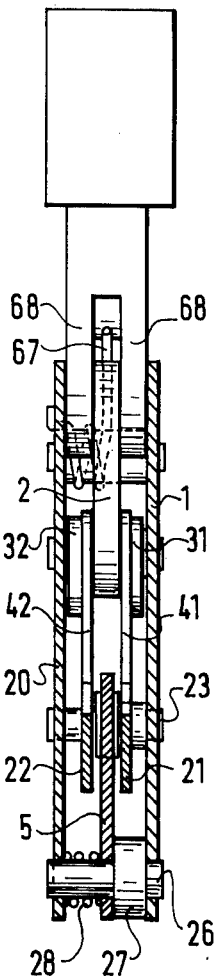
FIG. 4 is a cross-section about line 4—4 of the mechanism in FIG. 1.
Figure 7:
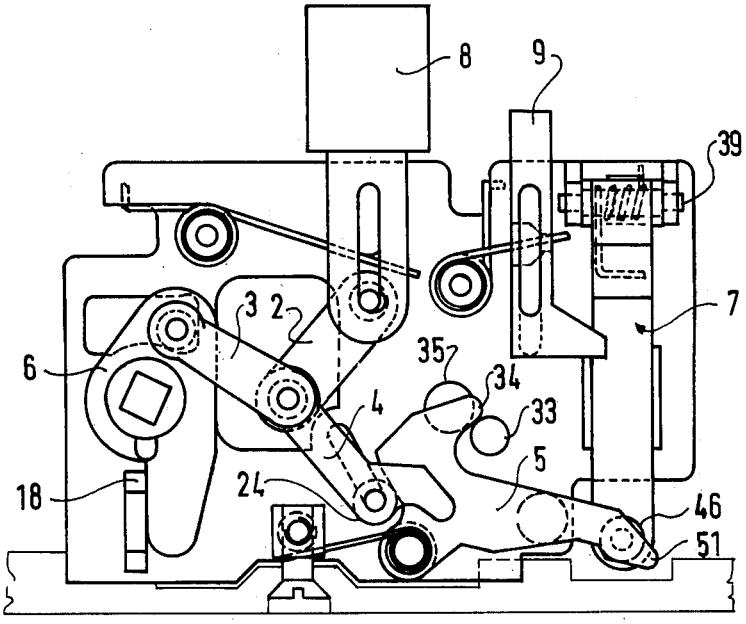
FIG. 7 is an elevation view of the mechanism in FIG. 1 at the instant of the release.

The pin 13 is used as an articulation for the main connecting rod 2, the secondary connecting rod 3 and the retaining connecting rod 4. The retaining connecting rod 4 is constituted by two identical parts 41, 42 inserted between the two parts 31, 32 of the secondary connecting rod 3, the main connecting rod 2 being inserted between the two parts 41 and 42 of the retaining connecting rod, as shown in FIG. 4. The parts 41 and 42 of the retaining connecting rod each comprise a projecting contour or projection 21, 22, so that the click 5 remains always between the parts 41 and 42 during its movement and the movement of the parts 41, 42, at the instant of the releasing such as shown in FIG. 7. The two parts 41 and 42 of the retaining connecting rod 4 are fixed, near the projecting contours 21, 22, by a pin 23 and held apart from each other by a roller 24 which is free on the pin 23. Each end of the pin 23 is engaged in an opening 25 formed in each of the bed-plates 1 and 20. The opening 25 is used as a guide for the movement of the axle 23 at the time of the tripping, of the release and of the cocking of the mechanism.

Figure 5:
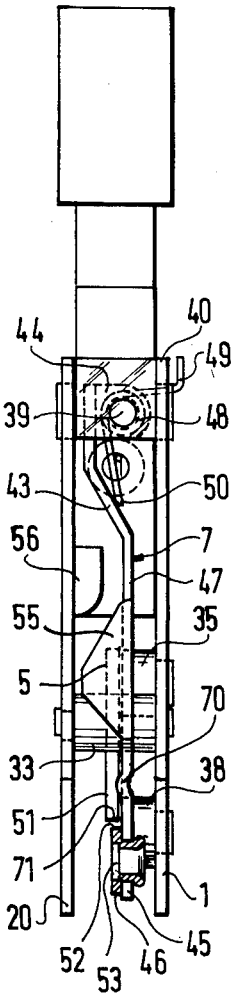
FIG. 5 is a right-hand view of the mechanism in FIG. 1.
Figure 6:
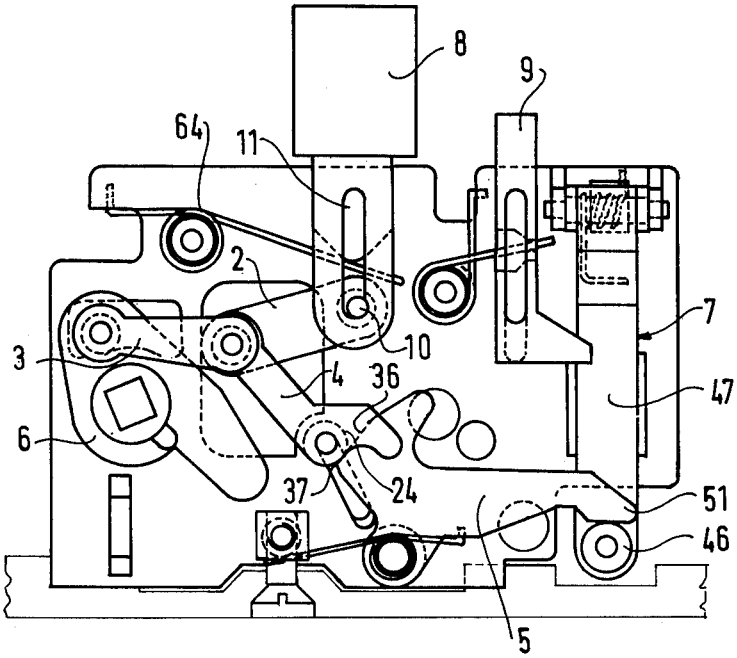
FIG. 6 is an elevation view of the mechanism in FIG. 1, in the tripped position.

The click 5 is positioned by a pin 26 on bed-plates 1 and 20 round which it can turn. The pin 26 comprises a shoulder 27 which is pressed against the bed-plate 1 and lies between the bed-plates 1 and 20. The click 5 is kept pressed against the shoulder 27 by a spring 28, coiled round the pin 26 between the click and the flange 20 and having one end 29 engaged under the fixing distance piece or stop 76 and the other end 30 engaged under the click 5. The coiled part of the spring 28 exerts on the catch 5 a force which presses it against the shoulder 27 and the end 30 exerts on the click a force which tends to make it rotate about the pin 26. The click 5, under the effect of the spring 28 comes into contact with a distance piece or stop 33 whose ends are engaged in holes formed in the bed-plates 1 and 20. The distance piece 33 is shown in FIGS. 1 and 5 and forms a stop for the click subjected to the action of the spring 28. The click 5 comprises a projecting contour or projection 34 which presses against a journal 35. The click also presses against a journal 38 near the flap 7. The thickness of the journals is equal to that of the shoulder 27 of the pin 26. The journals 35 and 38 are fixed on the bed-plate 1 and lie between the bed-plates 1 and 20. In this way, the click 5 is pressed, under the action of the spring 28, against the shoulder 27 and the journals 35 and 38 and its position is well-defined. During rotation the click always remains pressed against the shoulder 27 and the journals 35 and 38 and moves therefore in its plane. This is of great importance in the operation, for it makes it possible to obtain in a repetitive way the same relative positions between the click and the flap 7. The click 5 comprises an end 51 whose side 71 is polished. It also comprises 36 inclined towards the axle 23 and forming, with the axle of the opening 25 an angle "*a*" smaller than 90°. The control mechanism being in the tripped position, FIG. 6, the roller 24 presses against the edge 36 of the click 5, at the end 37 of the edge 36, so that a rotation of the click through a few degrees releases the roller 24 and hence releases the retaining connecting rod 4. By modifying, during manufacturing, the angle *a,* the effort applied by the click to the fixing stop 46 in the tripped position is made to vary. The flap 7 which is parallel to the bed-plates 1 and 20 pivots about a pin 39 supported by two identical bearings 40, each comprising two rectangular shoulders which are fitted into the flanges 1 and 20. The flap comprises a plane part 47 and a curved part 43 ending in two lugs 44, through the centre of which the axle 39 passes. A catch stop 46 is fixed to the lower end 45 of the plane part 47. The catch stop 46 is crimped onto the flap. The axle 39 is situated in the plane of the plane part 47, the flap 7 being mounted between the bed-plate 1 and the click 5. A spring 48 is coiled round the pin 39; one end 49 is bent back and fixed to the bed-plate 1, whereas the other end 50, also bent back, is in contact with the oblique part 43 of the flap; under the action of the spring 48, the flap 7 pivots in the direction of the bed-plate 20 and is pressed against the end 51 of the click 5. The catch stop 46 comprises, on the side nearest the click 5, a polished conical face 52, forming, with the axis of symmetry of the catch stop, an angle between 1° and 6°. Again on the side nearest the click 5, the fixing stop comprises a cylindrical recess 53 which enables the crimping thereof without any danger of damaging the conical face 52, or of forming a burr at the end of the conical face 52 which is the furthest from the flap 7. Adjacent the catch sop, the flap comprises a boss 70 which comes into contact with the end 51 of the click 5. The flap 7 comprises on a same side of the plane part 47, two ramps 54, 55. The ramp 54 is that situated, in FIG. 1, on the same side as the release knob 9. The release knob 9 comprises two bosses 57 which slide in openings 58 in the bed-plates 1 and 20 so that the movement thereof is parallel to the flap 7. A finger 56 at the lower end of the release knob comes into contact with the ramp 54 of the flap and makes it pivot towards the bed-plate 1 when the release knob is pressed in. That knob normally being in the high position under the action of a spring 59 coiled round a distance piece 60 fixed to each bed-plate 1 and 20. One end of the spring 59 is fixed to the flange 1, the other end being engaged in a hole 63 formed in the release knob 9.

The trip knob 8 is brought back into the high position, the mechanism not being tripped or released, by a spring 64 coiled round a distance piece 65 fixed to 1 and 20. One end 66 of the spring 64 is fixed to the bed-plate 1, the other end 67 being engaged, above the axle 10, between the two fingers 68 of the trip knob between which the main connecting rod 2 is inserted.

OPERATION

The operation of the control mechanism is as follows. In the non-tripped position, the various parts are in the position shown in FIGS. 1, 2, 3, 4 and 5. The roller 24 of the retaining connecting rod 4 does not touch the edge 36 of the click 5. The click 5 abuts on the distance piece 33, due to the action of the spring 28. The end 51 of the click is in contact with the boss 70 of the flap 7 (FIG. 5) but its side 71 does not press against the conical face 52 of the catch stop 46 (FIG. 5). In the tripped position, the various parts are in the position shown in FIG. 6, the trip knob 8 being in the low position; the secondary connecting rod 3 has moved towards the left, causing rotation of the control cam 6. The roller 25 of the retaining connecting rod 4 has come into contact with the edge 36, at the end 37 of the latter, of the click 5 and pressed against the latter, causing the rotation thereof, so that the side 71 of the end 51 of the click presses against the conical face 52 of the catch stop 46, which thus opposes a greater rotation of the click 5. The axle 10 articulating the trip knob 8 and the main connecting rod has fallen into the notch 12 of the opening 11 so that the trip knob 8 cannot rise to the high position under the action of its spring 64 and thus drive the main connecting rod 2.

The maintaining of the axle 10 in the notch 12 is ensured, not by the mechanism itself, but by the resultant force of the antagonistic effort applied to the control connecting rod (reaction of the controlled device).

At the time of a releasing action, which can be caused either by the manipulating of the release knob 9, which then acts upon the ramp 54 of the flap 7, thus causing the rotation thereof, or by the action of a device such as a rod, for example, acting upon the plane part 47 of the flap on the side nearest the click 5; the rotating of the flap 7 about its pin 39 releases the click 5 which, under the action of the roller 24 of the retaining connecting rod 4, pivots until its projecting contour 34 abuts against the distance piece or stop 33. FIG. 7 shows the position of the various parts of the control mechanism at the instant of the releasing, the various parts immediately assuming, immediately thereafter, the position shown in FIG. 1. In FIG. 7, it has been presumed that the flap 7 was subjected to the action of a device, not shown, which transmitted a releasing order. The click 5 which held back the roller 24 therefore pivots and releases the roller 24 which moves guided by its pin 23 which slides in the opening 25. The retaining connecting rod moves with the roller 24, driving the pin 13 in its movement. The secondary connecting rod 3 moves towards the right, under the action of the antagonistic effort of the controlled device. The control cam 6 returns to the position on the stop 18. The antagonistic effort having disappeared, the axle 10, under the effect of the spring 64, clears itself from the notch 12 and the trip knob 8 rises to its high position, driving, in its movement, the main connecting rod 2, the secondary connecting rod 3, and the retaining connecting rod 4 which resumes its "non-tripped" position as in FIG. 1 under the action of the spring 28. When the action of the device on the flap ceases, the latter resumes its position as in FIG. 1, that is, it presses, with its boss 70, against the end 51 of the click. Of course, the operation of the mechanism is the same when the releasing is caused by the release knob 9. It has been stated that the catch stop 46 comprised a polished conical face 52 forming an angle of 1° to 6° with the axis of the catch stop, the polished side 71 of the click pressing against the conical face when the mechanism is tripped. In this way, the friction between the click and the catch stop is as slight as possible and it is necessary only to apply to the plane part 47 of the flap, when the releasing order is transmitted by an outside device, a force which is sufficient for causing the rotation of the flap 7. That force is therefore all the weaker as the friction between the click and the catch stop is slight. In this way, it will be possible to obtain the releasing of the control mechanism with a low-power releasing order, this resulting in great sensitivity. It has also been stated that the plane part 47 of the flap and the axis of rotation 39 of the flap were in a same plane; the result of this is that at the level of the catch stop, the movement of the flap is effected practically perpendicular to the click. This does not give rise to extra friction between the click and the catch stop. Moreover, the click and the flap being in contact exclusively by the boss 70 of the flap, in this way, all sticking between the click and the flap is avoided, such sticking causing loss of sensitivity, since the force applied to the flap to cause the rotating thereof, hence the releasing of the control mechanism, must be greater than when there is no sticking.

The shape of the parts such as the flap 7, the journal 40, the axle 39, the spring 48, enables the assembling of the flap in the reverse configuration, that is, so that the flap, instead of being positioned between the click 5 and the bed-plate 1, is positioned between the click and the bed-plate 20. The click and the flap still being in contact by the boss 70, it is then possible to actuate a release device, for example a rod, on the side of the bed-plate 1. This causes the rotation of the flap towards the bed-plate 20. That device is therefore reversed in relation to the example described hereinabove, but of course, there is no change in the operation; this enables great versatility in assembling the release mechanism. Of course, the release knob 9 alone must be changed and will be replaced by a release knob whose finger 56 is situated against the bed-plate 1 instead of being against the bed-plate 20 as shown in FIG. 5.

It will be observed that the rotation of the flap is effected under the action of a force perpendicular to the flap, hence perpendicular to the click and to the bed-plates. Thus, at the time of the tripping, the shock which results from the manipulating of the trip knob 8 has no effect on the flap; there is therefore no danger of accidental releasing. Likewise, when the support 73 on which the control mechanism is fixed, by a screw 69, is fixed on a wall, the vibrations transmitted by the wall are in the plane of the flap and hence have no effect on the latter. The arrangment of the flap in the control mechanism therefore makes it possible to obtain high immunity to shocks and vibrations without being detrimental to the sensitivity.

Likewise, to reduce the friction of the moving parts, various precautions have been taken; thus, the axle 23 comprises shoulders so as to produce a lateral clearance between the connecting rods 41, 42 and the bed-plates. With the control cam comprising two studs 72 which ensure the guiding of the latter between the bed-plates and minimise the friction of the control cam with the bed-plates since they are only in contact with the bed-plates and whereas the axles 13 and 15, the secondary connecting rod 3 and the retaining connecting rod 4 move freely without danger of friction on the bed-plates 1 and 20 which comprise, for that purpose, wide openings 74, 75.

The control mechanism according to the invention is, to great advantage, used in circuit-breakers, more particularly, domestic consumers' circuit-breakers; the flap 7 then receives an order, either from an element detecting a permanent overcurrent, such as a bimetallic strip, for example, for thermal protection, or from an element detecting a short overcurrent which is however higher than a given value, for magnetic protection, or from an unbalance of current between the phases of an electric supply source, for differential protection, or from a fault current between a phase and a neutral wire or the earth, also for differential protection.

It must be understood that the invention is not limited to the example described and illustrated in the figures and it would be possible, without going beyond the scope of the invention to use any equivalent means or to modify certain arrangements.

We claim:

1. In a trip and release type control mechanism comprising:

two laterally spaced bed-plates, a main connecting rod, aligned elongated openings within flanges, an axle projecting through said openings and extending between said bed-plates and being articulated to one end of said main connecting rod, a trip knob articulated to said axle for movement therewith along with said main connecting rod, a secondary connecting rod, a retaining connecting rod, said secondary connecting rod being articulated on one end with the other end of said main connecting rod and being commonly articulated to one end of said retaining connecting rod, said elongated openings comprising at one end a notch into which said axle falls when the control mechanism is in trip position, a control cam, said control cam being articulated to the other end of said retaining connecting rod, said control cam comprising two cylindrical shoulders, a through hole drilled within said cylindrical shoulders for inserting a control shaft, said control cam being mounted for pivoting about said cylindrical shoulder, a pin mounted to said retaining connecting rod at a point remote from the articulation of said retaining connecting rod to said main connecting rod and said secondary connecting rod, a latch, a pivot pin spanning between said bed-plates for pivotably mounting said latch therebetween, a first spring coiled about said latch pin pivot and pressing said latch in release position against a first stop, a roller freely rotatable about said pin mounted to said retaining connecting rod on an edges of said latch, the improvement comprising:

second elongated openings within said bed-plates for receiving respective ends of the pin to which said roller is mounted, a release lever pivotably mounted at one end of said bed-plates at a position intermediate of said bed-plates and having at an opposite end facing the side of said latch, a catch stop fixed to the end of said release lever facing the side of said latch, said release lever comprising at least one ramp intermediate of said catch stop and said release lever pivot axis, said release lever extending parallel to said bed-plates and normally contacting said latch at a position above said catch stop, a second spring for biasing said release lever into contact with the side of said latch, a release knob mounted adjacent said release lever for movement along the side of said release lever and comprising a finger for contact with said at least one ramp to force said release lever to pivot against the bias of said second spring means away from the side of said latch to release said latch, and a third spring for biasing said trip knob to raised position at the end of said first elongated opening remote from said notch;

whereby, longitudinal movement of said release knob causes said finger in contacting said ramp to cause said release knob to release said latch whereby pivoting away from said latch, thereby permitting said latch to ride over the catch stop carried by said release lever.

2. The control mechanism according to claim 1, wherein said retaining connecting rod comprises two identical, laterally spaced parts with each part comprising a projection and wherein said latch lies between said projections which act as guides for said latch during pivoting of said latch about its pivot pin.

3. The control mechanism according to claim 1, wherein the longitudinal axes of said second opening forms with the edge of said latch upon which the roller presses in latched position an angle of less than 90°, with the pressure applied by the latch on the catch stop on the release lever being a function of said angle.

4. The control mechanism according to claim 1, wherein the biasing spring for said latch comprises a coil spring coiled about the pivot pin of the latch, said coil spring pressing said latch laterally, and wherein at least two journals are fixed to the bed-plate and said pivot pin for said latch is provided with a shoulder against which the latch presses with said shoulder being of the same thickness as said journals to maintain said latch in a plane parallel to the bed-plates.

5. The control mechanism according to claim 1, wherein said catch stop comprises a conical face on which said latch abuts when the control mechanism is in tripped position, and wherein the conical face forms an angle of between 1° and 6° with the axis of symmetry of said catch stop.

6. The control mechanism according to claim 1, wherein said release lever comprises a plane part in the plane of the axis of rotation of said release lever facing said latch, above the catch stop with said plane part further comprising a boss for contact with the end of said latch when the latch is in control mechanism latch position.

7. The control mechanism according to claim 1, wherein aligned holes are provided within said for receiving the cylindrical shoulders of the control cam to define the axis of rotation of said control cam, and wherein the through hole passes through the center of said cylindrical shoulders and wherein two studs are situated on respective sides of the control cam to ensure centering thereof between the bed-plates.

8. The control mechanism according to claim 1, wherein said release lever comprises an oblique portion intermediate of its ends connecting parallel planar portions at respective ends such that said release lever may be mounted to each of said laterally spaced bed-plates, permitting the biasing effort to be exerted on either side of said latch depending upon the position of said release lever in relation to the latch and to the bed-plates.

9. The control mechanism according to claim 5, wherein said catch stop comprises, on the side nearest the conical face, a recess for the crimping of said stop to said release lever.

* * * * *